United States Patent [19]

Fukushi

[11] Patent Number: 4,557,589

[45] Date of Patent: Dec. 10, 1985

[54] SORTING APPARATUS

[75] Inventor: Yukihiro Fukushi, Yokohama, Japan

[73] Assignee: Tokyo Shibaura Denki Kabushiki Kaisha, Kawasaki, Japan

[21] Appl. No.: 547,356

[22] Filed: Oct. 31, 1983

[30] Foreign Application Priority Data

Nov. 5, 1982 [JP] Japan ..... 57-193446
May 26, 1983 [JP] Japan ..... 58-92661

[51] Int. Cl.[4] ..... G03G 15/00
[52] U.S. Cl. ..... 355/14 SH; 271/269
[58] Field of Search ..... 355/3 SH, 14 SH, 3 R; 271/265, 269

[56] References Cited

U.S. PATENT DOCUMENTS 4,090,787 5/1978 Hubbard et al. ..... 355/14 R
4,411,515 10/1983 Kukueka et al. ..... 355/14 SH

FOREIGN PATENT DOCUMENTS 0022233 2/1983 Japan ..... 271/265
2112361 11/1982 United Kingdom ..... 271/265

*Primary Examiner*—A. T. Grimley
*Assistant Examiner*—David S. Warren
*Attorney, Agent, or Firm*—Cushman, Darby & Cushman

[57] ABSTRACT

In a sorting apparatus which is mechanically coupled to, but electrically independently operated from a copying machine, the sorting operation is realized. A copy delivery time interval between a front end of a first copy and a front end of a second copy is measured and stored with an addition of a tolerance time in a memory. Such a measurement is repeated for the succeeding copies. During the measurement if the time interval exceeds a predetermined basic time longer than the time interval, the sorting apparatus recognizes that the original document was substituted by new one. Then the storing way in the sorting apparatus is changed to receive copies of the new original document.

9 Claims, 9 Drawing Figures

SORTING APPARATUS

BACKGROUND OF THE INVENTION

1. Field of the Invention

This invention generally relates to a sorting apparatus for image forming apparatus, and more particularly, to a sorting apparatus which is electrically operable independently from the image forming apparatus.

2. Descriptions of Prior Art

In this specification, it is defined that the terminology "image forming apparatus" is understood as not only the normal copying machines, but also facsimiles, laser printers, duplicating machines and so on. It is therefore defined that the word "copy" is understood as "a paper sheet on which an image of an original document is formed".

Generally speaking, the sorting apparatus as mentioned in the preamble must recognize user's operation conditions for the image forming apparatus, such as the copy quantity, and the substitution of documents. For instance, to recognize the document substitution, the sorting apparatus is usually clasified into two types i.e., one for requiring the transmitter/receiver which may communicate the signals to the sorting apparatus, and the other for no requirement of the transmitter/-receiver.

In the former sorting apparatus, such a transmitter/-receiver is unnecessary when the user wishes to operate the image forming apparatus without using the sorting apparatus. Moreover there are disadvantages that the entire construction of the sorting apparatus is complicated, and the inter connection between the sorting apparatus and the image forming apparatus gives inconvenience to the user.

On the other hand, the latter sorting apparatus usually comprises detection means which may detect image-recorded materials (=copy paper or sheets) delivered in turn from the copying machine in order to recognize the document substitution.

Various recognition means have been proposed.

For example, one recognition mean is provided in the sorting apparatus that delivery time intervals "TI" of a plurality of copies which are in turn delivered from the copying machine are detected so as to recognize the document substitution. If the detected delivery time interval "TI" exceeds a predetermined time "Ts", the sorting apparatus may recognize that the document substitution is most probably done by the user, so that it may set the sorting condition for the new document.

In the sorting apparatus of te type, so-called "an auto-reset mechanism" is provided to return the copy holding bins to the non-sorting mode when the first sorting operation is completed so as to perform correctly a second sorting operation.

An explanation of this auto-reset mechanism will be briefly made as follows. That is, the quantity setting of the sorting operation by one user in this sorting apparatus may be determined by a plurality of copy sheets with respect to the first original document in case of the sorting mode. Accordingly the same user must set again the sorting mode if the sorting quantity for the second original document is different from the first one. If another user however wishes to sort the copies based upon newly-set quantity of the copy, the sorting operation is mistakenly effected because the previously-set sorting quantities are being stored in the memory. The function of the auto-reset mechanism is therefore to return the non-sorting mode (=normal single copy mode) when the sorting apparatus is not continuously operated for more than a predetermined time period so as to avoid such troubles.

However, the following disadvantages are provided in the auto-reset mechanism. That is, when the above-described auto-reset operation begins, the sorting bins are transported to the non-sorting bin position. Since this bin transportation is effected by mechanical means, the total time of the bin transportation requires considerably longer than the copy duplicating time (the copying speed). As a result if the copying machine is mistakenly operated during the bin transportation, the mulfunction, e.g., a paper jam occurs because as previously described, the copying machine is not electrically communicated to the sorting machine. Furthermore when the paper supply cassette becomes empty during the copying operation, the auto-reset mechanism may be occasionally in operative during a replenishment of the copy paper into the paper supply cassette. Consequently if the user doesnot become aware of the operation of the auto-reset mechanism and continues the copying operation, all of the copy paper is held in a single sorting bin under the non-sorting mode.

A primary object of the invention is to provide a sorting apparatus for an image forming apparatus in which the succeeding sorting operation is automatically performed by erasing the memory content (copy quantity) of the preceding sorting operation when the delivery of a copy is not detected for more than a predetermined time period.

A secondary object of the invention is to provide a sorting apparatus for an image forming apparatus, which sorting apparatus is not electrically communicated to the image forming apparatus.

SUMMARY OF THE INVENTION

These objects of the present invention will be accomplished by providing a sorting apparatus comprising:

a plurality of means for holding copies which are fed from an image forming device to a copy receiving section of the sorting apparatus;

means for individually transferring said plurality of copy holding means to said copy receiving section;

means for detecting said copies which are fed from the image forming device and delivered to one of said copy holding means which is individually transferred to said copy receiving section by said transferring means;

means for counting a delivery time interval of the copies between an rear end of one copy and a front end of a succeeding copy;

means for storing said delivery time interval after being additionally summed with a first predetermined basic value as a second predetermined basic value; and means for comparing said delivery time interval to said second predetermined basic value and for controlling to transfer said plurality of copy holding means in view of original exchange when said delivery time interval exceeds said second predetermined basic value during the comparision.

Further those will be realized by providing a sorting apparatus comprising;

a plurality of means for holding copies which are fed from an image forming device to a copy receiving section of the sorting apparatus;

means for individually transferring said plurality of copy holding means to said copy receiving section;

means for detecting said copies which are fed from the image forming device and delivered to one of said copy holding means which is individually transferred to said copy receiving section by said transferring means;

means for counting a delivery time interval of said copies between a front end of one copy and a front end of a succeeding copy;

means for storing a predetermined basic value; and means for comparing said delivery time interval of said copies and said predetermined basic value and for controlling to stop said transferring means and said counting means in view of original exchange when said delivery time interval exceeds said predetermined basic value.

BRIEF DESCRIPTION OF THE DRAWINGS

These and other objects and features of the present invention become apparent with reference to the following specification and to the drawings in which.

DETAILED DESCRIPTION OF THE PREFERRED EMBODIMENTS

A detailed description of the invention, as given in this specification, is organized in accordance with the following index which is presented for the convenience of the reader.

1. GENERAL DESCEIPTION OF SORTING APPARATUS COMBINED WITH ELECTROPHOTOGRAPHIC COPYING MACHINE
2. CONSTRUCTION OF SORTING APPARATUS
   (2-A) MECHANISM
   (2-B) OPERATION PANEL
   (2-C) PAPER DETECTION SWITCH
3. GENERAL DESCRIPTION OF SORTING APPARATUS' OPERATIONS
   (3-A) NON-SORTING MODE
   (3-B) SORTING MODE
   (3-C) GROUPING MODE
4. OTHER SORTING OPERATIONS
   (4-A) OVER PAPER
   (4-B) PAPER JAM
5. DETAILED DESCRIPTION OF SORTING MODES
   (5-A) CONSTRUCTION OF SORTER CONTROL CIRCUIT
   (5-B) NON-SORTING MODE
   (5-C) SORTING MODE

1. GENERAL DESCRIPTION OF SORTING APPARATUS COMBINED WITH ELECTROGRAPHIC COPYING MACHINE

Figure 1:
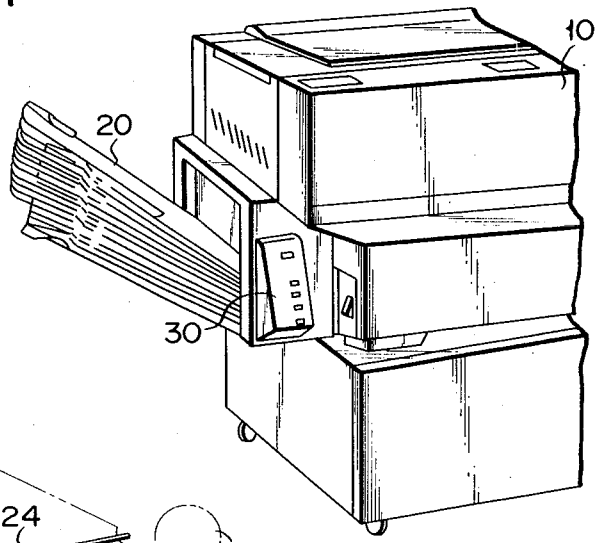
FIG. 1 represents an illustration of a sorting apparatus combined with an electrophotographic copying machine, according to the invention.

Referring to FIG. 1 there is shown a sorting apparatus (referred to as "sorter" hereinafter) according to the invention which is combined with an electrographic copying machine (referred to as "copying machine" hereinafter).

As will be explained in more detail later, the sorter 20 is mechanically connected to the copying machine 10, but has no electrical connection with it. That is, there is no electrical communication between them with respect to the quantity of the multicopy, and the original substitution. When a copy is delivered from a copy delivery end (not shown) of the copying apparatus 10, the sorter 20 therefore commences its sorting operation.

On an operation panel 30 of the sorter 20, three kinds of mode selection buttons are provided for selecting a non-sorting mode, a sorting mode and a grouping mode. Further, warning lamps for a paper jam, an over sorting set (referred to as "over paper" hereinafter) and a reset button are provided thereon.

2. CONSTRUCTION OF SORTING APPARATUS

(2-A) MECHANISM

Figure 2:
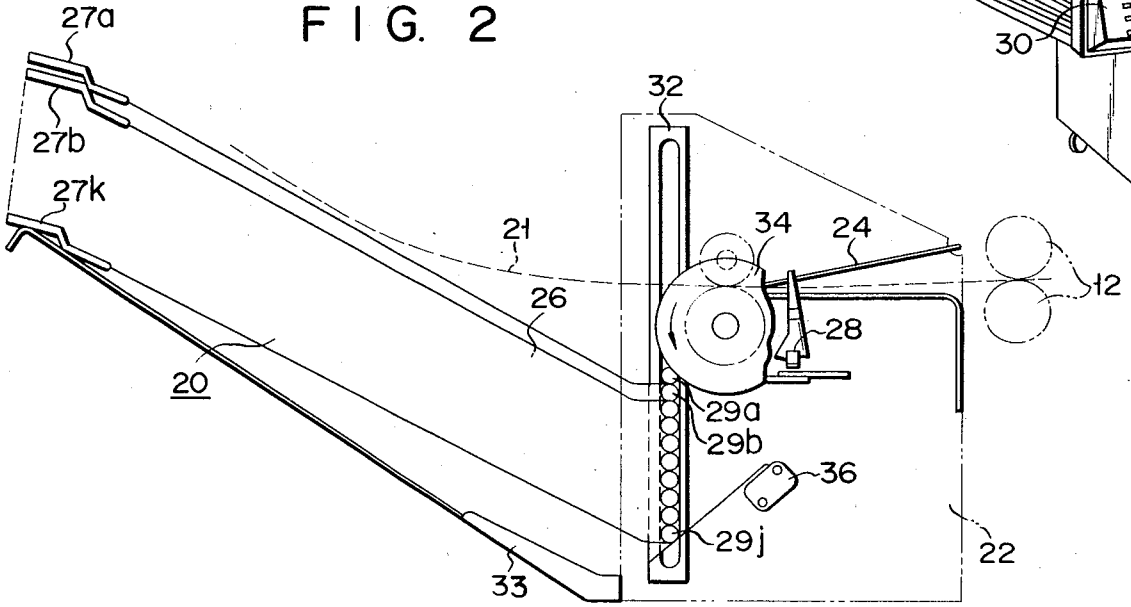
FIG. 2 represents an illustration of a construction of a sorting apparatus according to one preferred embodiment of the invention.

FIG. 2 shows a basic mechanism of the sorter according to one preferred embodiment of the invention, A description will be now given of the basic operation with reference to FIG. 2.

Right side of a housing 22 (surrounded by two-dot/-dashed line) of the sorter 20 is mechanically connected to the copying machine 10. As a result, a plurality of copies 21 (illustrated by a dot line) can be delivered through a delivery roller 12 of the copying machine 10 into the sorter 20. To accept those copies 21 from the delivery roller 12 into the sorter 20, a copy receiver 24 is arranged which is faced with the delivery roller 12. A shape of the copy receiver 24 is substantially a wedge in its cross sectional view, so that the delivery operation of copy sheets or paper is effectively and smoothly achieved to the bin section 26. Around the copy receiving position of the copy receiver 24 a paper detection switch 28 is provided for detecting the copies 21 delivered from the copying machine 10 to the sorter 20.

A construction of the bin section 26 will now be explained.

A plurality of sorting bins **27*a* to 27*k* (10 sorting bins and 1 non-sorting bin in this embodiment) are positioned in the vertical direction and spaced at a given equivalent distance. One end (left side in the drawing) of the sorting bin is a free end and pins 29*a* to 29*j* are secured to the other end thereof. The pins 29*a* to 29*j* are arranged to be slidable in an elongated hole section 32. One end of the most low sorting bin 27*k* is contacted to one end of a supporter 33 so as to support the bin section 26. The other end of this sorting bin 27*k* is fixed to the housing 22 of the sorter 20**.

A cam section 34 for feeding the sorting bins **27*a* to 27*k* is provided near the delivery end of the copy receiver 24 so as to control the slide operation of the bin section 26 in the vertical direction. The operations of the cam section 34 are as follows. First, when the non-sort mode button (will be described later) is depressed, a bin feeding motor 73 is energized. As a result, a bin feed cam 35 is rotated, so that all of the bins 27*a* to 27*k* are transported during every half rotation in the lower direction (viewed in the drawing) until a bottom switch 36 is depressed by the most low sorting bin 27*k*. By depressing the bottom switch 36 the bin feeding motor 73 is de-energized, so that all of the sorting bins 27***a* to 27*k* have been transported and are stopped at the lower position as shown in the drawing. Under this condition when the copy 21 is fed from the copying machine 10, it is delivered to the upper surface of the most upper non-sorting bin 27*a* as shown by a dot line. Although there is not shown in the drawing, a copy feeding roller is positioned around the copy delivery end of the copy receiver 24, which is driven by the copy feeding motor 74. This motor 74 is controlled by the paper detection switch 28. The copy feeding motor 74 is so designed that it is de-energized unless the paper detection switch 28 is depressed by a front end of the succeeding copy (viewed in the copy feeding direction) within approximately 6 seconds since the switch 28 has been turned off (released).

(2-B) OPERATION PANEL

Figure 3:
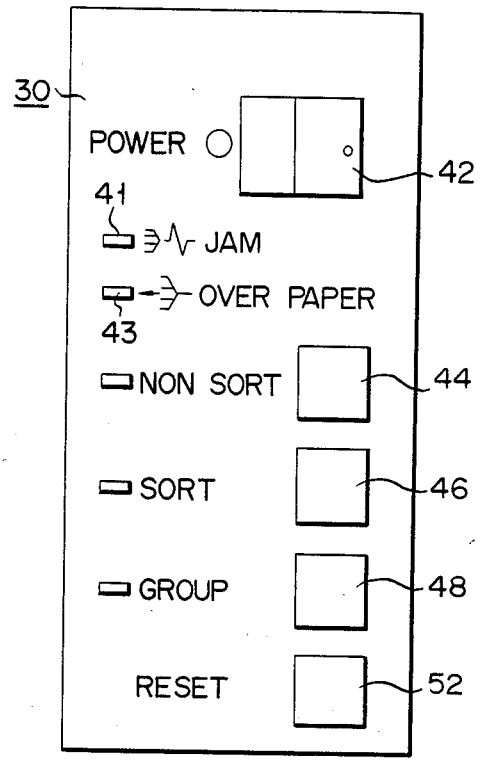
FIG. 3 is a front view of the operation panel of the sorting apparatus shown in FIG. 2.

FIG. 3 is a front view of the operation panel 30. A power switch 42 is provided at the upper position of the operation panel 30, which may control entirely the power supply of the sorter 20. Three mode selection switches are positioned in a center portion of the operation panel 30 and spaced at a given distance. Those are a non-sorting mode switch 44, a sorting mode switch 46 and a grouping mode switch 48 respectively. Under the grouping mode switch 48 a reset button 52 is arranged. Display lamps are provided near the corresponding buttons 44, 46, 48 and 52 respectively, which lamps are turned on when the corresponding button is depressed (turned on).

Further a paper jamp warning lamp 41 and an over paper warning lamp 43 are arranged between the power switch 42 and the non-sorting mode switch 44.

It should be noted that all of the operation switches 42, 44, 46, 48 and 52 has no electrical connection with the copying machine 10. Accordingly even if the copying machine 10 is operated under the multicopy mode, a plurality of copies cannot be sorted in the sorter 20 unless the sorting mode button 46 is turned on. Moreover even if the paper jam occurs in the sorter 20, the delivery of the copies 21 is continued because the copying machine has no way to recognize such a trouble.

The reset button 52 is prepared not for resetting the mode selection buttons, but for returning the bin section 26 back to the original position i.e., the position at which the paper jam occured or the paper empty lamp was turned on.

(2-C) PAPER DETECTION SWITCH

Figure 4A:
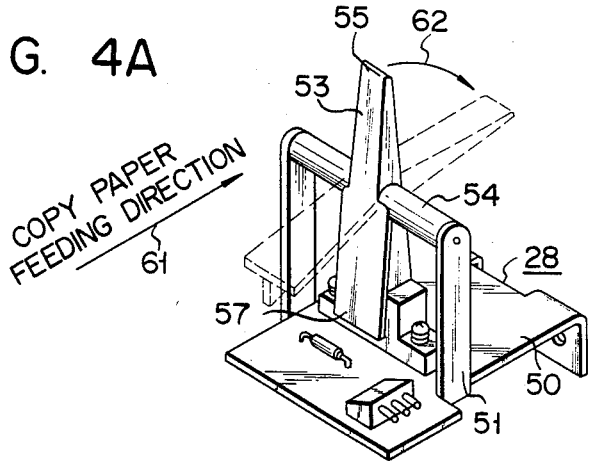
FIG. 4A represents an illustration of the paper detection switch of the sorting apparatus shown in FIG. 2.

Functions of the paper detection switch 28 which may detect a supply of the copies 21 from the copying machine 10 to the sorter 20 will be explained with reference to FIGS. 4A and 4B.

As previously described, turning on the paper detection switch 28 enables commencement of the entire sorter operation to be controlled.

The paper detection switch 28 is constituted by a switch body 50, a switch sensor section 54 and a photodetection circuit section 56. The sensor section 54 is pivotally journaled to a yoke section 51 of the switch body 50. A center of a sensor tip 53 of the sensor section 54 is rotatable, and as one end 55 of the sensor tip 53 is made light in weight compared with the other end 57 thereof, the above-mentioned end 55 is stationary with projecting toward an upper direction of the drawing during no paper detection.

When a copy 21 is fed in a direction denoted by an arrow 61, one end 55 of the sensor tip 53 is depressed by the front end of the copy 21 and rotated with respect to its center as indicated by an arrow 62. This depression condition of the sensor tip 53 is continued to keep the turn-on of the switch 28 until the rear end of the copy 21 has passed over the end 55. The other end 57 which does not contact with the copy 21 at all may interrupt an photo detection path 63 of the photo detection circuit 56 (will be explained later).

Figure 4B:
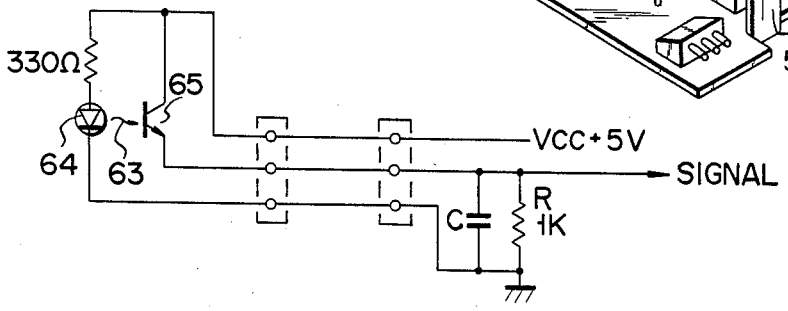
FIG. 4B is a circuit diagram of the optical paper detection switch circuit shown in FIG. 4A.

One preferred circuit of the photo detection circuit 56 is shown in FIG. 4B. The circuit shown in FIG. 4B is per se known in the art, so that a brief explanation will be given A LED (light emitting diode) 64 and a photo transistor 65 are connected in parallel to each other, and a detection signal may be derived from the emitter of the transistor 65. The LED 64 and the photo transistor 65 are spaced at a given phisical distance in such a manner that photo energy emitted from the photo transistor 65 can be reached to a light receiving surface of the photo transistor 65 with keeping its sufficient intensity. By arranging those elements in the above positioning condition, the photo detection path 63 is formed, which is interrupted by the other end 57 of the sensor tip 53. An RC parallel circuit which is connected between the emitter of the photo transistor 65 and the cathode of the LED 64 functions as an RF noise filter.

3. GENERAL DESCRIPTION OF SORTING APPARATUS OPERATION (3-A) NON-SORTING MODE

Before the copying machine 10 is operated, the non-sorting mode button 44 of the operation panel 30 is turned on. By doing so all of the sorting bins 27*a* to 27*k* are transferred to the bottommost position (shown in FIG. 2). Accordingly all of the copies 21 which are delivered from the copy receiving position of the sort 20 is held by the non-sorting bin 27*a* which is located at the topmost position of the bin section 26 (corresponding to "non-sorting bin No. 1").

(3-B) SORTING MODE

As same as in the previous operation of (3-A), the sorting mode button 46 is depressed (on) before the copying machine 10 is brought into the operation mode. Then the bin feeding motor 73 is energized and thus all of the sorting bins 27*a*–27*k* are returned to the buttommost position during the rotation of the cam 35 of the cam section 34. As soon as the bottom switch 36 is depressed (on) by the bottommost sorting bin 27*k*, the rotation direction of the bin feeding motor 73 turns in a reverse direction. Then only the topmost non-sorting bin 27*a* begins to lift up. As a result the sorting bin 27*b* (corresponding to "sorting bin No. 1") is set to the copy receiving position (the delivery end of the copy receiver 24). By doing so, the sorting mode is set.

In the present embodiment, five copies for each of the original documents are to be sorted in the sorter 20.

(B-1) 1st copy sorting operation

When the first original document is duplicated by the copying machine 10 and thus the first copy is fed to the delivery end 24 of the sorter 20, the paper detection switch 28 is turned on by the front end of the copy. Then the copy feeding motor 74 is energized (shown in FIG. 5) and the first copy is delivered from the delivery end 24 into the sorting bin No. 1 (27*b*).

(B-2) 2nd copy sorting operation

As soon as the rear end of the first copy has passed over the detection tip 53 of the paper detection switch 28, the bin feeding motor 73 is immediately energized so that since the sorting bin No. 1 (27*b*) is lifted up by one step, the sorting bin No. 2 (27*c*) is brought to the copy receiving end. Because this preparation time period for the sorting bin No. 2 is sufficiently shorter than the time interval of the continuous feeding of the copies, there is no risk that the second copy is delivered from the delivery end while the non-sorting bin No. 1 is lifted up by one step. Otherwise the paper jam occurs.

(B-3) 3rd to 5th copy sorting operation

As already described in the above (B-1) and (B-2), a similar operation is performed for the third copy and the succeeding copies. That is, the delivery of each copy is effected by the depression operation of the front end of each copy, and the bin feeding motor 73 is energized by releasing the depression of the switch 28 by the rear end of each copy. Thereafter the preparation of the next copy delivery is accomplished. After the fifth copy is held by the sorting bin No. 5 (27*f*), this sorting bin No. 5 is lifted up by one step so that the next bin No. 6 (27*g*) is arranged to the delivery end of the copy receiving section 24.

(B-4) sorting controlling operation

An electrical measuring operation will be explained with respect to the sorting mode.

The feature of the present sorter 20 is such that although a selection of the sorting mode is executed by the switch 46 on the operation panel 30, the sorting quantity is not set by any operation element, but automatically set by electrically detecting the delivery time conditions of the copies which have been delivered from the delivery end of the sorter 20.

That is, a time interval "T2" of the copy delivery between the first copy and the second copy for the first original document is measured by the paper detection switch 28. This time interval "T2" is memorized as a delivery basic time (will be explained later).

A time interval "T2'" is measured between the second copy and the third copy, and then compared with the previously-measured time interval "T2". In general, since there exists tolerance in the copy feeding timing, the delivery time interval of the copy has no constant value. If the comparsion result as "T2"<"T2'", the former time interval "T2" is remained as the basic time value. If "T2">"T2'", the latter time interval "T2'" is newly stored.

After accomplishing the duplication of the first original document, it is replaced by a second one, and thereafter a first copy for the second original document is delivered from the copying machine 10. A time interval "T3" between the rear end of the fifth copy for the first original document and the front end of the first copy for the second original document is naturally longer than the delivery time interval "T2".

If the longer time interval "T3" is detected by the paper detection switch 28, a detection is made for the original document replacement. As soon as this detection is made, the last sorting bin No. 5 (27*f*) is lifted down by one step for preparing the copy reception with respect to the second original document.

After this operation step, a similar copy sorting operation as in the first original document will be effected for the second original document. It should be noted that in this second sorting step the first copy of the second original document is inserted into the sorting bin "No. 5". In other words the sorting direction with respect to the first original document is completely opposite to that for the second original document, or the sorting direction (the copy sorting order) of the copies of the even-numbered orignal document is a reverse relation to that of the odd-numbered one.

As easily understood from the foregoing descriptions, when a series of the sorting operation has been completed, all of the sorting bins (27*a* to 27*k*) are not always located at the bottommost position. Precisely speading, when the last copy of the last original document is sorted into the corresponding sorting bin, this sorting bin is once lifted up by one step so as to bring the succeeding sorting bin to the delivery end of the copy receiving section 24. Thereafter if a next sorting operation is executed, the sorting bin for holding the last copy is shifted down by one step so as to receive a first copy of the second original document.

(3-C) GROUPING MODE

As similarly being done in the previous (3-A) and (3-B) initial operations, the grouping mode button 48 on the operation panel 30 is depressed. Subsequently the sorting bin No. 1 (27*b*) is elevated up to the delivery end of the copy receiving section 24.

When th desired quantity of copies, e.g., five sheets for the first original document is duplicated in the copying machine 10, a first copy to a fifth copy are delivered in turn from the copying machine 10 to the copy receiving section 24. The front end of the first copy enables the copy feeding motor 74 to be energized, so that this copy is inserted into the sorting bin No. 1. The second to fifth copies are stored similarly in this sorting bin No. 1.

During this grouping operation, the time interval "T2" for the subsequent copies is measured and stored.

Thereafter the duplication starts for the second original document. The desired quantity of the copy may be freely decided, for instance, five sheets. It is evident that a time interval "T3" is longer than the above-described time interval "T2", which interval "T3" is defined by such a time interval that since the paper detection switch 28 is released by the rear end of the fifth copy for the first original document until it is depressed by the front end of the first copy for the second original document.

Accordingly if the comparision result between the time intervals "T2" and "T3" is "T3">"T2", the sorter 20 may recognize the replacement of the document, so that the bin feeding motor 73 is energized. Hence the above sorting bin No. 1 (27*b*) for holding five copies of the first original document is lifted up by one step, and the sorting bin No. 2 (27*c*) is set to the delivery end of the copy receiving section 24. All copies of the second original document are stored in this sorting bin No. 2. The similar sorting operation is repeatedly effected for completing this grouping mode sorting operation.

4. ANOTHER SORTING OPERATIONS

The sorter 20 according to the invention involves the following sorting operations other than the sorting operations (3-A), (3-B) and (3-C).

(4-A) OVER PAPER

As described in (2-A), there are provided ten sorting bins in this embodiment. When more than ten copies are therefore delivered from the copying machine 10 under the sorting mode, the sorting operation fails. In this case, the eleventh copy and the succeeding copies are sorted into the sorting bin "No. 10" (27*k*), the over paper lamp 43 on the operation panel 30 is turned on, and the warning sound "pee" is made for the user.

(4-B) PAPER JAM

A detection of the paper jam and a warning thereof are executed as follows.

When a copy delivered from the copying machine 10 keeps to depress the paper detection switch 28 for a predetermined time period "T8", e.g. more than 3.5 seconds, the sorter 20 may recognize such a condition as the paper jam. That is, when the depression time of the paper detection switch 28 is compared to the time period "T8" in the CPU 84, if this time exceeds "T8", it is recognized as the paper jam. When the paper jam is detected, the copy feeding motor 74 is immediately turned off. Simultaneously the paper jam lamp 41 is turned on, and the warning sound for the paper jam is created. After the user repairs the paper jam, both the paper jam lamp and the warning sound are stopped.

Since this paper jam occurs in the sorter 20 and therefore the given sorting bin is correctly prepared for accepting the succeeding copy after repairing the mulfunction, the user can merely continue the sorting mode operation. In this mulfunction, although he depresses the reset button 52 on the operation panel 30, no specific correction operation is executed.

On the other hand if the paper jam occurs in the copying machine 10, he can known it from the mulfunction indication of the copying machine. Accordingly after repairing such a mulfunction, it is required to depress the reset button 52 because the succeeding sorting bin was already arranged to receive the succeding copy though the preceeding sorting bin did not hold the preceding (last) copy. When the reset button 52 is depressed, the following specific correction operation is made. That is, the quantity of the copy which has been stored in the memory 86 is cleared, and the preceeding sorting bin which did not yet hold the last copy is returned to the copy delivery end, so that the preparation for the normal mode operation is accomplished.

It should be noted that the above-mentioned time interval "T8" must be distinguishable (e.g., long) from the time interval for requiring that of the document substitution.

5. DETAILED DESCRIPTION OF SORTING OPERATIONS

Although a series of the sorting operations of the sorter 20 according to the invention has been briefly described in the item (3-B), the featured points of the sorter will now be explained in greater detail.

(5-A) CONSTRUCTION OF SORTER CONTROL CIRCUIT

Figure 5:
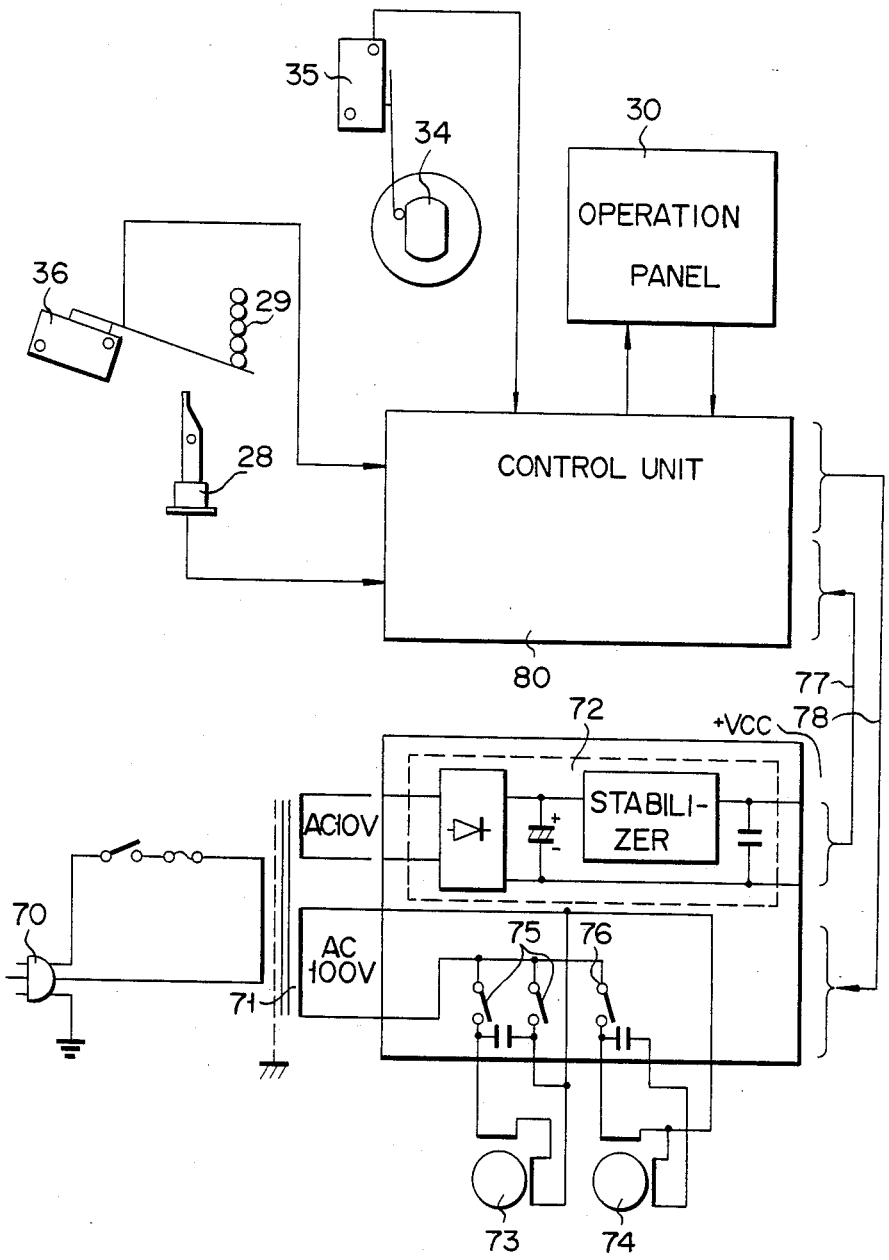
FIG. 5 shows a schematic diagram of the electrical circuitry of the sorting apparatus shown in FIG. 2.

A circuit for controlling the above-described sorting operations and an entire control circuit arrangement for the sorter 20 will now be explained with reference to FIG. 5.

A power supply source 70 is connected to a primary circuit of a power transformer 71, and an AC 10 V circuit and an AC 100 V circuit are connected to a secondary circuit thereof. To the AC 10 V circuit, a rectifier and stabilizer circuit 72 is connected so as to apply a DC voltage to electronics circuits of the sorter 20 via a power cable 77. On the other hand, to the other AC 100 V circuit, the bin feeding motor 73 and the copy feeding motor 74 are connected in parallel through semiconductor switches 75 and 76. Those semiconductor switches 75, 76 are controlled to be turned on/off under the control of drive instruction signals which are fed from the electronic circuits via a signal cable 78.

Those electronic circuits are mounted in a control unit 80. Other than the above-mentioned signal cables 77 and 78, the paper detection switch 28, the bottom switch 36 and a switch 35 for the cam section 34 are connected to the control unit 80. The operation panel 30 is also connected to the control unit 80.

Figure 6:
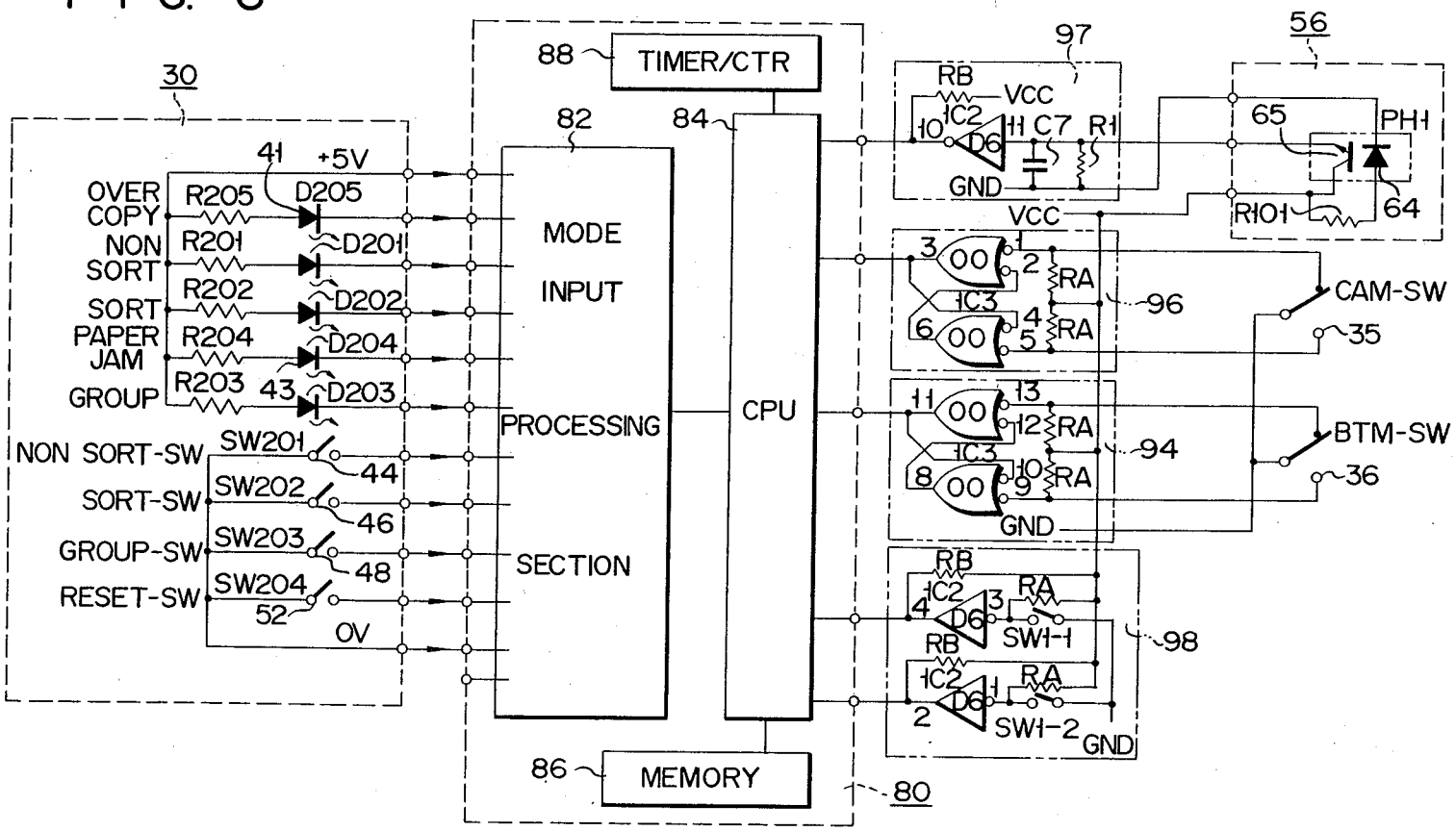
FIG. 6 is a circuit diagram of the control unit shown in FIG. 5.
Figure 7:
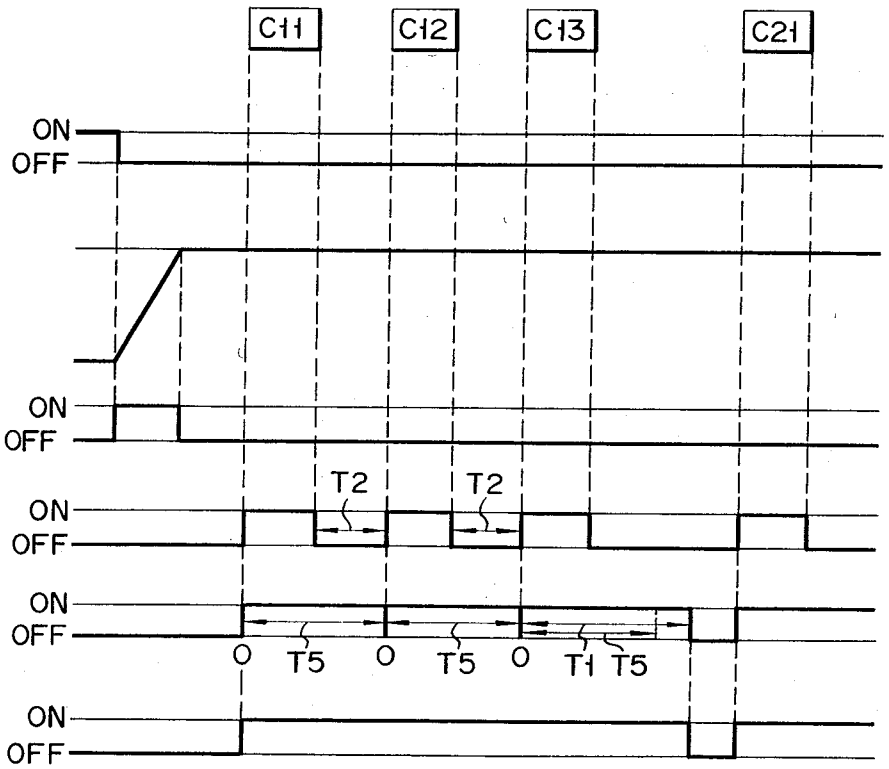
FIG. 7 shows a timing chart explanining the non-sorting mode operation of the sorting apparatus shown in FIG. 2.

Referring to FIG. 6, an internal circuit diagram of the control unit 80 and an operation thereof will be explained.

The mode selection switches 44, 46, 48, the reset switch 52 and the relative display lamps' circuit of the operation panel 30 are connected to a mode input processing section 82 of the control unit 80. The output terminal of the mode input processing section 82 is connected to the CPU 84. The memory 86, the timer/counter 88, the photo-detection circuit 56 of the paper detection switch 28, a cam switch 35 of the bin feeding motor 73 and a bottom switch 36 of the copy feeding motor 74 are also connected to the CPU 84. Those switches 35 and 36 are connected to the CPU 84 through flip-flop circuits 94, 95 for preventing chattering. Similarly the photo-detection circuit 56 is connected via an inverter-buffer circuits 97, and 98 to the CPU 84.

The following control operation will be performed.

When one of the mode selection switches 44, 46, 48 is turned on, a descrimination signal belonging to the activated mode switch is generated from the mode input processing section 82. The descrimination signal is transmitted to the CPU 84 and processed therein, so that a corresponding program stored in the memory 86 is read out, and then executed under the control of the CPU 84. For instance, the switch 75 of the bin feeding motor 73 is changed over so as to energize the bin feeding motor 73. As a result, the bin 27 is controlled to execute a predetermined feeding operation. Then the switch 76 is changed over, the copy feeding motor 74 is energized so that the copy 21 is delivered from the copy receiving section 24 to the given sorting bin 27.

Since the timer/counter 88, and the paper detection switch 28 are connected to the CPU 84, the time interval "T2" of the copy delivery and the time interval "T3" of the original substitution are measured, and each of which is compared to the basic time. As will be described in more detail later, after a predetermined time (e.g. 30 seconds) has passed, the subtraction operation for the timer/counter 88 is effected, and an interruption is made to the CPU 88, do that a sorting quantity for new copies is started to be stored in the memory 86.

Another operations such as the over paper, the paper jam detection, the reset are effected in the control unit 80.

(5-B) NON-SORTING MODE

Referring to the operation timing of the CPU 84 shown in FIG. 6, the non-sorting mode of the sorter 20 will be explained.

The following description is given to such a case that three copies are required for two different original documents. First the non-sort mode switch 44 is turned on (FIG. 3), and then the CPU 84 receives the mode discrimination signal from the non-sort mode switch 44 to start its non-sorting mode control. Hence the CPU 84 causes the bin feeding motor 73 to be energized by sending the drive signal thereto. As a result, all of the sorting bin 27 are lifted downward by the motor 73 which continues to rotate until the topmost non-sorting bin **27*a* is positioned to face with the delivery roller of the delivery end (not shown). Subsequently the copying machine 10 starts its reproduction operation to deliver a first copy C11 on which an image of the first original document is formed, by means of the delivery roller 12 out from the copying machine 10. When the actuator of the paper detection switch 28 is touched by the front end of the first copy C11, it is turned on and continues to supply the detection signal to the CPU 84 until the copy C11 passes through the switch 28. As soon as the CPU 84 receives the detection signal, the operation control signal is also supplied to the timer/counter 83 therefrom. Accordingly the feeding roller (not shown) starts to rotate and simultaneously the timer/counter 88 starts its counting operation. When the timer/counter 88 begins its counting operation, the CPU 84 compares the basic time "T1" sorted in the memory 86 with the count value "T5" at a given timing. It is noted that the count value "T5" is a time interval which is measured since the front end of one copy turns the switch 28 on until the front end of the succeeding copy turns it on. During the comparison by the CPU 84, the comparision result is always T5>T1 because the second copy C12 and the third copy C13 are delivered in turn from the copying machine 10. Consequently the timer/counter 88, the copy feeding motor 74** and the copy feeding roller continue to their operation.

Then since the front end of the third copy C13 of the first original document depresses the paper detection switch 28, if the time interval between turning on the switch 28 by the 3rd copy C13 for the first original and by the 1st copy C21 for the second original exceeds the count value "T5", the CPU 84 may recognize the original substitution from the first one to the second one. Then the CPU 84 controls that the drive stopping signal is fed to the feed roller motor or the copy feed motor 74 so as to interrupt its rotation and also the timer/counter 88 is reset.

Thereafter when the first copy C21 of the second document is fed by the feed roller to the sorter 20 and thus turns on the paper detection switch 28, the CPU 84 sends the drive signal to the timer/counter 88 so as to restart its counting operation.

Consequently once the feed roller motor 74 starts to rotate for the given time interval "T1", and countinues its rotation if the paper detection switch 28 is turned on by the front end of the succeeding copy C22 before the time "T1" has passed. Since the feed roller keeps its rotation when the copies C22 and C23 are delivered to the feed roller, these copies are fed into the non-sorting bin 27*a* by means of the fed roller.

The above description is to explain the control operation of the CPU 84 during the non-sorting mode.

(5-C) SORTING MODE

Referring to the operation timing of the sorter 20 shown in FIG. 8, the sorting mode operation will be described in which "n" numbers of copies are duplicated for one original document and sorted respectively one by one into the sorting bins 27.

As similarly in the non-sorting mode, the CPU 84 starts its control operation by receiving a sort mode signal from the sort mode selection switch 46. That is, when the sort mode switch 46 is turned on, the CPU 84 may cause the bin feeding motor 73 to be energized by receiving the sort mode signal, so that the sorting bin 27 is lifted up by one step. The sorting bin "No. 2" (27*b*) is faced with the copy delivery end of the copy receiving section 24. Subsequently if the copying machine 10 is operated by the user, a first copy C11 for a first original document is fed to the copy feed roller. When the paper detection switch 28 is turned on by the front end of the first copy C11, it delivers a paper detection signal to the CPU 84, whereby the CPU 84 may cause the feed roller to be rotated (as the control of the feed roller is identical to that of the non-sorting mode, the explanation thereof will be omitted).

When the rear end of this copy C11 releases the depressed actuator of the paper detection switch 28 (i.e., when the rear end of the copy C11 is detected by the switch 28), the delivery of the paper detection signal to the CPU 84 is interrupted, and then the CPU 84 sends its operation signal to a timer/counter 88-B so that it starts the counting operation. It is understood that this timer/counter 88-B has a function to control the bin feeding motor 73, which is distinguishable from the timer/counter 88. For the sake of simplicity, this timer/counter 88-B is included in the timer/counter 88 in FIG. 6.

Under these conditions when the timer/counter 88-B begins to count, the time data "T1" is read through the CPU 84, and thereafter is compared at the given timing to the count value of the timer/counter 88-B. When the CPU 84 determines that the count value of the timer/counter 88-B is equal to the timer "T4", the drive signal is sent to the bin feeding motor 73 and the sorting bin 27 is lifted up by one step so as to be positioned to the feed roller. Within the timer/counter 88-B counts the time "T4", the first copy C11 is held by the first sorting bin 27*b*. Then the timer/counter 88 continues its counting operation, and if the count value exceeds the time "T7" and the paper detection switch 28 does not detect the front end of the second copy C12, the CPU 84 may recognize that the user mistakenly reproduces single copies one by one, although the sorter 20 is set to the sorting mode. Accordingly the counting of the timer/counter 88-B is immediately stopped and the alarm sound is made to call his attention to the user who must know the incorrect mode setting.

If before the counting value (time) of the timer/counter 88-B exceeds the time "T7" the front end of the second copy C12 is detected by the detection switch 28, the CPU 84 may cause the operation of timer/counter 88 to be stopped and write in the memory region of the memory 86 a time "T3" which is obtained by adding the time data "t" stored in the memory 86 to the count value "T2" of the timer/counter 88-B. It should be noted that since the time "T3" has the similar function to the time "T5", it is a basic time so as to determine the original substitution.

Then when the second copy C12 is detected by the detector 28, the counting of the timer/counter 88-B is again effected by the CPU 84. If the counting value of the timer/counter 88-B becomes the time "T4" (in other words, the second copy C12 is held in the second sorting bin 27C), the sorting bin 27 is lifted up by one step so that the third sorting bin 27*b* is positioned to the feed roller. Subsequently the CPU 84 compares the time "T3" written in the memory region to the count value "T2*a*" of the timer/counter 88-B. If the front end of the third copy C13 is detected before the count value "T2*a*" exceeds the time "T3", the CPU 84 may cause the counting operation of the timer/counter 88-B to be interrupted. Further if the rear end of the third copy C13 is detected by the detection switch 28, the counting operation of the time/counter 88-B is newly started. When the count value of the timer/counter 88-B is equal to "T4", the sorting bin "No. 4" (27*e*) is arranged to be opposite to the copy delivery end. As already explained, the third copy C13 is sorted in the third sorting bin 27*d* while the timer/counter 88-B counts the time T4. The similar sorting operation will be accomplished for the succeeding copies.

The operation of the time count of the sorter 20 will now be summarized. The timer/counter 88-B measures the time interval "T2" of the copy delivery under the control of the CPU 84, and the time data "t" for tolerance of the copy feeding is added to the time interval "T2", which will then be written in the memory region of the memory 86. After this memory initialization, a time interval of the delivery of the succeeding copies C13 to C1*n* is measured by the timer/counter 88-B at every timing when the copy after the second copy C12 passes over the paper detection switch 28. Then the time interval as "T2*a*" is compared with the time "T3" written in the memory region.

On the other hand, in the sorting mode, since more than two copies are continuously duplicated in the copying machine 10, a plurality of copies C11 to C1*n* for the first original document are in turn delivered from the copying machine 10 with a substantially constant time interval and pass over the paper detection switch 28. The above time interval is substantially equal to the delivery time interval "T2" which is measured by the timer/counter 88-B. Accordingly the delivery time interval "T2*a*" for the second and the succeeding copies C12, C13, . . . C1*n* is always shorter than the time "T3" which is obtained by adding the time "t" for tolerance to the time interval "T2" unless the original is substituted by the user. If the copy delivery time interval "T2*a*" is shorter than the time "T3" (namely if the rear end of the Kth copy (K>2) is detected by the detection switch 28, simultaneously the counting operation of the timer/counter 88-B is commenced, and the front end of the (K+1)th copy is detected before the counting value becomes "T3"), the above-described control operation of the CPU 84 which is done in such a time period from the rear end of the second copy C12 being detected till the rear end of the third copy C13 being detected, is repeatedly performed becuase the original document is not yet changed.

Figure 8:
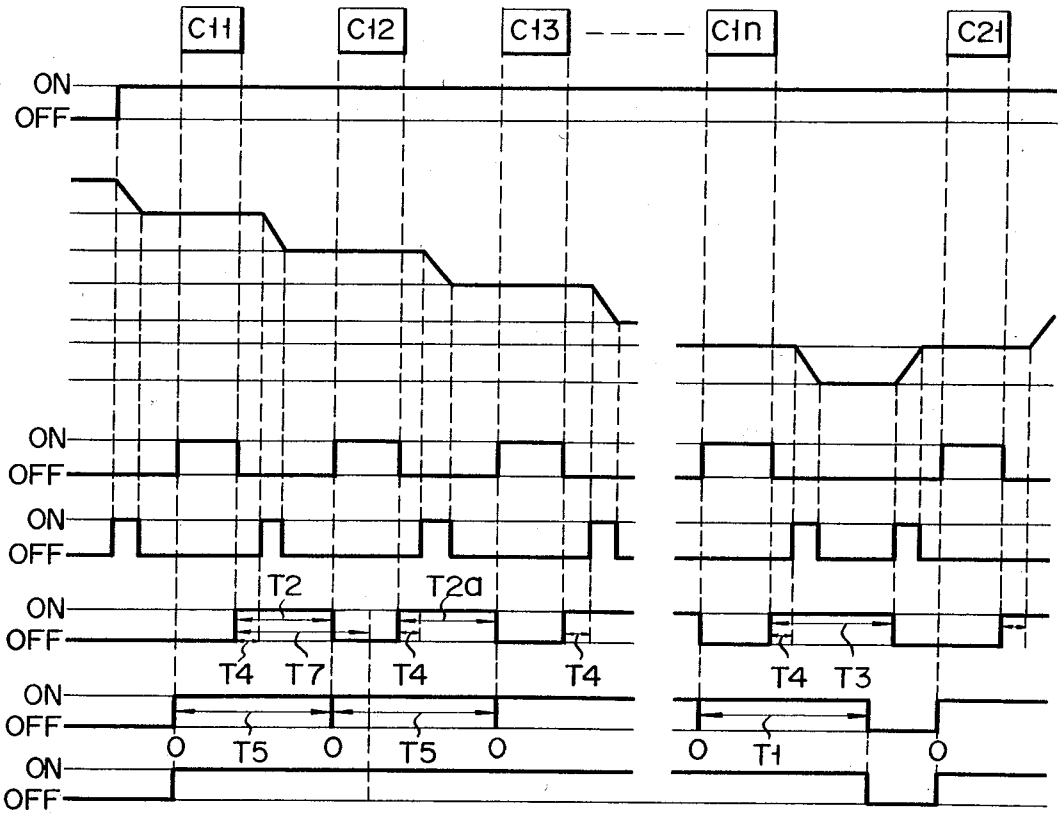
FIG. 8 shows a timing chart explaining the sorting mode operation of the sorting apparatus shown in FIG. 2.

On the other hand, as shown in FIG. 8, when the rear end of the copy C1*n* (n=10) is detected and the counting operation of the timer/counter 88-B is started, the counting value thereof becomes "T3". However at this time "T3" there is no detection signal from the paper detection switch 28 becuase the first original document is substituted by a second original document. Accordingly the CPU 84 may determine that the original substitution was done at this time "T3". Simultaneously the CPU 84 causes the counting operation of the timer/-counter 88-B to be stopped and also the memory region to be cleared, and thereafter the sortig bin 27 to be shifted down by one step so as to position the last sorting bin to the copy delivery end of the receiving section 24.

Then if the front end of the first copy C21 for the second original document is detected, the CPU 84 continues to repeat the above-described control operation. It should be noted that in this sorting period the bin transfer direction is completely opposite to that in the first sorting period: Consequently when the last cpy C2*n* for the second original document has been held in the sorting bin "No. 1" (27*b*) and thereafter the counting value of the timer/counter 88-B becomes "T4", which starts its counting operation by detecting the rear end of the nth copy C2*n*, the non-sorting bin (27*a*) is shifted down by one step to receive a next copy at the copy delivery end. When the counting value of the timer/counter 88-B is again equal to "T3", the CPU 84 may recognize that the last original was changed by new one. As previously described, at that time that timer/counter 88-B is interrupted and the memory content of the memory region is cleared. Further more than sorting bin "No. 1" (27*b*) is lifted up by one step to be positioned to the copy delivery end. If further copies C31 to C3*n* for the third original document are delivered from the copying machine 10, the control operation of the CPU 84 is repeated. In other words, when the CPU 84 may recognize the document substitution, only transporting operation of the sorting bin 27 is changed every sorting cycle.

As previously described in the foregoing embodiments, there are provided the following advantages in accordance with the invention.

First, since the copy machine is electrically independent from the sorter according to the invention, no electrical modification is required for the copying machine when the sorter is coupled thereto. Moreover the construction of the sorter is made simple, the total manufacturing cost can be reduced.

The specific sorting operation can be realized in which the different sorting quantities are continuously set, this specific sorting operation being impossible in the conventional auto-reset sorter, becuase the sorting quantity set is correctly refreshed when the original is changed.

The sorter according to the invention can avoid that the sorting mode is accedentally reset during the copying operation.

While the invention has been described in terms of certain preferred embodiments, and exemplified with respect thereto, those skilled in the art will readily appreciate that various modification, changes, ommissions and substitutions may be made without departing from the spirit of the invention.

For example, each electronics circuits in the control unit 80 can be easily assembled in a one chip microprocessor.

The optical paper detection switch 28 may be alternatively substituted by a high sensitive mechanical switch.

What is claimed is:

1. A sorting apparatus comprising:

a plurality of means for holding copies which are successively fed from an image forming device to a copy receiving section of the sorting apparatus, said sorting apparatus being operable electronically independent from said image forming device;

means for individually transferring said plurality of copy holding means to said copy receiving section in a predetermined direction so as to receive said copies successively fed from said image forming device;

means for detecting said copies which are successively fed from the image forming device to produce detection signals;

means for counting a first delivery timer interval between a rear end of one copy and a front end of a succeeding copy in response to said detection signals;

means for storing said first delivery time interval after being additionally summed with a first predetermined basic value, as a second delivery basic time thereby refreshing said second delivery basic time; and means for comparing said first delivery time interval with said second delivery basic time and for controllably stopping transfer of said plurality of copy holding means in response to an original exchange when said first delivery time interval exceeds said second delivery basic time during the comparison operation.

2. A sorting apparatus as claimed in claim 1, wherein it further comprises:

operation mode selection means connected via a mode input selection section to said comparing and controlling means and including at least a sort mode selection switch and a non-sort mode selection switch wherein said plurality of copy holding means are individually transferred in said predetermined direction to said copy receiving section when said sort mode selection switch is actuated, while only one of said copy holding means is transferred to said copy receiving section when said non-sort mode selection switch is actuated.

3. A sorting apparatus as claimed in claim 1, wherein said copy detecting means includes a work piece pivotally journalled to a yoke, and an optical detection means having an LED and a photo-transistor which are separated from each other so as form therebetween an optical detection path, one end of said work piece being touched by said copies successively fed from the image forming apparatus, and said optical detection path being interrupted by the other end of said work piece.

4. A sorting apparatus as claimed in claim 2 wherein, upon actuation of said sort mode selection switch, said transferring means alternately transfers said plurality of copy holding means one by one in first and second opposite directions whenever said comparing and controlling means recognizes said original exchange by measuring said first delivery time interval.

5. A sorting apparatus comprising:

a plurality of copy-holding means for holding copies successively fed from an image forming device to a copy receiving section of the sorting apparatus, said sorting apparatus being operable electronically independent from said image forming device;

transfer means for individually transferring said plurality of copy holding means to said copy receiving section in a predetermined direction so as to receive said copies successively fed from said image forming device;

detecting means for detecting said copies which are fed from the image forming device to produce detection signals;

counting means for counting a first delivery time interval of said copies between a front end of one copy and a front end of a succeeding copy in response to said detection signals;

storing means for storing a second basic time; and comparing and controlling means for (a) comparing said first delivery time interval of said copies with said second basic time, and (b) stopping the transfer operation of said transferring means and the counting operation of said counting means in view of an original exchange when said first delivery time interval exceeds said second basic time.

6. A sorting apparatus as claimed in claim 5 further comprising:

operation mode selection means connected via a mode input selection section to said comparing and controlling means and including at least a sort mode selection switch and a non-sort mode selection switch, wherein said plurality of copy holding means are individually transferred in said predetermined direction to said copy receiving section when said sort mode selection switch is actuated, while only one of said copy holding means is transferred to said copy receiving section when said non-sort mode selection switch is actuated.

7. A sorting apparatus as claimed in claim 5 wherein, said copy detecting means includes a work piece pivotally journalled to a yoke, and an optical detection means having an LED and a photo-transistor which are separated from each other so as to form therebetween an optical detection path, one end of said work piece being touched by said copies successively fed from the image forming apparatus, and said optical detection path being interrupted by the other end of said work piece.

8. A sorting apparatus as claimed in claim 6 wherein, upon actuation of said sort mode selection switch, said transferring means alternately transfers said plurality of copy holding means one by one in first and second opposite directions whenever said comparing and controlling means recognizes said original exchange by measuring said first delivery time interval.

9. A sorting apparatus for a copy machine of the type including an image-forming means capable of forming successive copies of an original document and then successively conveying said copies to a copy-receiving section, said sorting apparatus being operable electronically independent from said image forming means and comprising:

means defining a plurality of copy-holding bins each operatively positionable adjacent said copy-receiving section for holding respective ones of said copies successively conveyed to said copy-receiving section;

transfer means connected to said copy-holding bins for individually sequentially transferring, in first and second opposite directions, said copy-holding bins into operative position adjacent said copy-receiving section so as to enable said copy-holding bins to receive copies successively conveyed thereto from said image forming means;

detecting means for detecting each said copy which is successively fed from said image forming means and for responsively generating respective detection signals;

counting means operatively connected to said detecting means for receiving said detection signals and for counting a first delivery time interval for said copies between a predetermined end of one copy and a predetermined end of a succeeding copy in response to receiving said detection signals; and control means connected to said transfer means and including storing means for storing a second basic time, said control means for comparing said first delivery time interval to said second basic time to responsively generate an original exchange signal indicative of a change from a first original document to a second original document to be copied when said first delivery time interval exceeds said second basic time, wherein said transfer means, in response to receiving said original exchange signal, stops the sequential transfer, in said first direction, of said copy-receiving bins into operative position adjacent said copy-receiving section and then sequentially transfers said copy-receiving bins in said second direction, opposite to said first direction, whereby copies of said second original document are sequentially received in said copy-receiving bins in reverse order as compared to copies of said first original document received therein.

* * * * *